US006157245A

United States Patent [19]

Rincon-Mora

[11] Patent Number: 6,157,245

[45] Date of Patent: Dec. 5, 2000

[54] EXACT CURVATURE-CORRECTING METHOD FOR BANDGAP CIRCUITS

[75] Inventor: Gabriel A. Rincon-Mora, Allen, Tex.

[73] Assignee: Texas Instruments Incorporated, Dallas, Tex.

[21] Appl. No.: 09/277,920

[22] Filed: Mar. 29, 1999

[51] Int. Cl.[7] ..... G05F 3/02

[52] U.S. Cl. ..... 327/539; 327/513

[58] Field of Search ..... 323/312, 313, 323/314, 315; 327/512, 513, 539, 540, 541, 543

[56] References Cited

U.S. PATENT DOCUMENTS 5,900,773 5/1999 Susak ..... 327/539

6,016,051 1/2000 Can ..... 323/315

*Primary Examiner*—Jeffrey Zweizig

*Attorney, Agent, or Firm*—J. Dennis Moore; Wade James Brady, III; Frederick J. Telecky, Jr.

[57] ABSTRACT

A curvature corrected bandgap reference voltage circuit, the output voltage of which is substantially linear and independent of the operating temperature of the circuit. The circuit includes a voltage divider network comprised of a first resistor and a second resistor connected in series. A first compensating circuit provides a first, linear, operating temperature-dependent current, and a second compensating circuit provides a second, logarithmic, operating temperature-dependent current. The first current is supplied to the first resistor of said voltage divider network, while the second current is supplied to the second resistor of the voltage divider network.

6 Claims, 3 Drawing Sheets

EXACT CURVATURE-CORRECTING METHOD FOR BANDGAP CIRCUITS

FIELD OF THE INVENTION

The invention relates generally to bipolar transistor electronic circuits having linearized the voltage-temperature characteristics, and more particularly relates to bandgap reference supplies with exact curvature correction.

BACKGROUND OF THE INVENTION

Reference voltage supplies are required in a wide variety of electronic systems to provide a known value of voltage to which a signal of interest may be compared to. The most common application is as the reference voltage input for a comparator to determine if a signal of interest has attained or exceeded some predetermined value.

A bandgap reference is typically designed around known base-emitter characteristics of bipolar transistors to provide circuit parameters suitable for this application. Manufacturing processes for bipolar transistors are also stable and easily manipulated to provide a wide range of transistor performance parameters that are independent of temperature.

The bandgap type of reference supply provides a high accuracy, temperature-compensated or temperature-independent output voltage that, ideally, is directly proportional to only the energy-bandgap voltage of the semiconductor material in a bipolar transistor. To realize the ideal condition requires compensating for or canceling the non-linear characteristics of a transistor circuit that are temperature dependent, which is referred to as curvature correction.

The temperature dependence of a bandgap reference can be seen in the equation for the base-emitter voltage of a forward-biased bipolar transistor:

$$V_{BE} = V_{g0} - \frac{T}{T_R}\left(V_{g0} - V_{BE\text{-}T_R}\right) - (n - x)\left(\frac{kT}{q}\right)\ln\left(\frac{T}{T_R}\right), \quad \text{Eq. (1)}$$

where:

$V_{g0}$ is the energy-bandgap voltage at zero degrees Kelvin, $T_R$ is a reference temperature, T is the operating temperature of the transistor, $V_{BE-T_R}$ is the base-emitter voltage at temperature $T_R$, n is a process-dependent but temperature-independent variable, x relates to the exponential order for the temperature-dependent collector current of the transistor, i.e., $I_C \propto T^X$, k is Boltzmann's constant, and q is the electrical charge of an electron.

It can be seen from this equation that the transistor's base-to-emitter voltage is inherently non-linear with temperature due to the logarithmic term that contains the ratio of the two temperatures.

Bandgap references are usually referred to as having first or second order compensation. A first order type is one whose design addresses only the linear terms in Equation (1), with the remaining terms being ignored. A second order type is one whose design is able to overcome some of the non-linearity associated with the logarithmic term in Equation (1) in addition to addressing the linear terms.

The operation of a bandgap reference typically requires summing two voltages, the first of which is base-emitter dependent in accordance with Equation (1), and the second of which is dependent upon a proportional to absolute temperature (PTAT) current. The summation of the two voltages is utilized in achieving the curvature correction, as will be presented below.

FIG. 1 is a schematic diagram for a PTAT current generator arrangement that utilizes a PTAT generator, comprising NPN transistors Q1 and Q2, resistor R1, and an active current mirror circuit CM1. The current mirror circuit CM1 forces the collector currents of transistors Q1 and Q2 to be equal which is shown as $I_c$ in signal lines S1 and S2. If the small base current of Q1 is ignored it can be seen in FIG. 1 that:

$$V_{BE1} + I_C R1 = V_{BE2};\ \text{or},\ I_C = \frac{V_{BE2} - V_{BE1}}{R1}. \quad \text{Eq. (2)}$$

The base-emitter voltage for transistors Q1 and Q2 is given by the equation:

$$V_{BE} = V_T \ln\left(\frac{I_C}{J_S A}\right), \quad \text{Eq. (3)}$$

where:

$V_T$ is a thermal voltage, $I_C$ is the collector current of an NPN transistor, $J_S$ is the saturation current density, and A is the emitter area.

$V_T$ is given by the equation:

$$V_T = \frac{KT}{q}, \quad \text{Eq. (4)}$$

where:

K is Boltzmann's constant,

T is the operating temperature of the transistor, and q is the electrical charge of an electron.

Substituting equations (3) and (4) into Equation (2) yields:

$$I_C = \left(\frac{1}{R1}\right)\frac{KT}{q}\left[\ln\left(\frac{I_C}{J_{S2}A_2}\right) - \ln\left(\frac{I_C}{J_{S1}A_1}\right)\right]. \quad \text{Eq. (5)}$$

Expanding Equation (5) yields:

$$I_C = \left(\frac{1}{R1}\right)\frac{KT}{q}\left[\ln(I_C) - \ln(J_{S2}A_2) - \ln(I_C) + \ln(J_{S1}A_1)\right]. \quad \text{Eq. (6)}$$

The saturation current density $J_S$ and emitter area A for a given transistor are constant, as are R1, K, and q. The first and third logarithmic terms cancel each other, and the second and fourth logarithmic terms are constants.

Equation (6) may therefore be simplified to:

$$I_C = (\text{constant}) \times T = I_{PTAT}, \quad \text{Eq. (7)}$$

making the collector current of Q1 in FIG. 1 directly proportional to absolute temperature T. This current is mirrored by current mirror CM1 to signal line S4 as $I_{PTAT}$.

The circuit of FIG. 1 is included in a preferred embodiment of the invention shown in discussion below. Variations of this circuit are also used in the known art to establish a circuit current that is dependent only on absolute temperature.

FIG. 2 is an example of the prior art and is a partial schematic for a first order bandgap reference that sums a PTAT voltage and a diode junction voltage to arrive at a partially compensated output reference voltage. The output reference voltage is given by:

$$V_{REF}=V_{PTAT}+V_D=I_{PTAT}R2+V_D. \quad \text{Eq. (8)}$$

The diode voltage, $V_D$, can be characterized by Equation (1) presented earlier, and $I_{PTAT}$ varies only with temperature in accordance with Equation (7). The PTAT voltage increases linearly with temperature and partially offsets the negative influence of $V_D$.

The overall performance of the bandgap reference of FIG. 2 can be understood from FIG. 3. This figure illustrates the temperature dependence of both the PTAT voltage and diode voltage, and the resulting output reference voltage. The curve labeled $V_D$ is derived from Equation (1) and reflects the increasingly nonlinear influence with temperature of the logarithmic term. The curve labeled $V_{PTAT}$ is derived from $I_{PTAT}$R2 and is linear with temperature. The curve labeled $V_{REF}$ is the resultant output reference voltage in FIG. 2 and shows the effect of summing the PTAT voltage with the diode junction voltage.

It can be seen that the first order bandgap reference of FIG. 2 exhibits considerable non-linearity with temperature, but would be suitable over a limited temperature range.

FIG. 4 is another example of the prior art and is a partial schematic for a second order bandgap reference that sums a base-to-emitter voltage of a transistor, a PTAT voltage, and a squared PTAT voltage to arrive at the output reference voltage:

$$V_{REF}=V_{BE3}+2I_{PTAT}(R3+R4)+I^2_{PTAT}R4. \quad \text{Eq. (9)}$$

Voltage $V_{BE3}$ can be characterized by Equation (1), and $I_{PTAT}$ varies linearly with temperature in accordance with Equation (7). The collector currents of transistors Q3 and Q4 are equal by virtue of the current mirror circuit CM2. The squared PTAT voltage, $I^2_{PTAT}$R4, in Equation (9) serves to offset the increasingly negative $V_{BE3}$ as the operating temperature of the circuit increases.

The performance of the circuit in FIG. 4 is illustrated in FIG. 5, which is similar to FIG. 3 with the addition of the curve labeled $V^2_{PTAT}$. The effect of the squared PTAT voltage on circuit performance can be seen by comparing the curves labeled $V_{REF}$ in FIGS. 3 and 5. The variation of $V_{REF}$ in FIG. 5 is much less pronounced with temperature variations than that in FIG. 3 due to the use of $I^2_{PTAT}$ in the circuit of FIG. 4.

SUMMARY OF THE INVENTION

The invention is disclosed in the context of its usage in providing a bandgap reference voltage that is independent of operating temperature. In accordance with the present invention there is provided a curvature corrected bandgap reference voltage circuit, the output voltage of which is substantially linear and independent of the operating temperature of the circuit. The circuit includes a voltage divider network comprised of a first resistor and a second resistor connected in series. A first compensating circuit provides a first, linear, operating temperature-dependent current, and a second compensating circuit provides a second, logarithmic, operating temperature-dependent current. The first current is supplied to the first resistor of said voltage divider network, while the second current is supplied to the second resistor of the voltage divider network.

These and other features of the invention will be apparent to those skilled in the art from the following detailed description of the invention, taken together with the accompanying drawings.

DETAILED DESCRIPTION OF THE PREFERRED EMBODIMENTS

The embodiment of the present invention disclosed herein is comprised of bipolar and CMOS transistor circuits arranged to achieve a substantially exact curvature correction for a bandgap reference. These circuits are combined in such a fashion that the temperature dependence of various transistor performance parameters are canceled or offset substantially completely to realize an output voltage that is temperature-independent.

Circuits are included to generate three distinct currents. The first current is linear and proportional only to absolute temperature; the second current is temperature-dependent and proportional to a bipolar transistor's base-emitter voltage in accordance with Equation (1); and the third current is a first order function independent of temperature. The three currents are used to develop voltages in an output stage comprised of a resistive voltage divider to achieve a temperature-independent voltage.

Known base-emitter characteristics of a bipolar transistor, with respect to temperature, are used in generating the aforementioned three currents. Temperature-independent parameters are used, determined by manufacturing processes that are stable and well-characterized.

Figure 6:
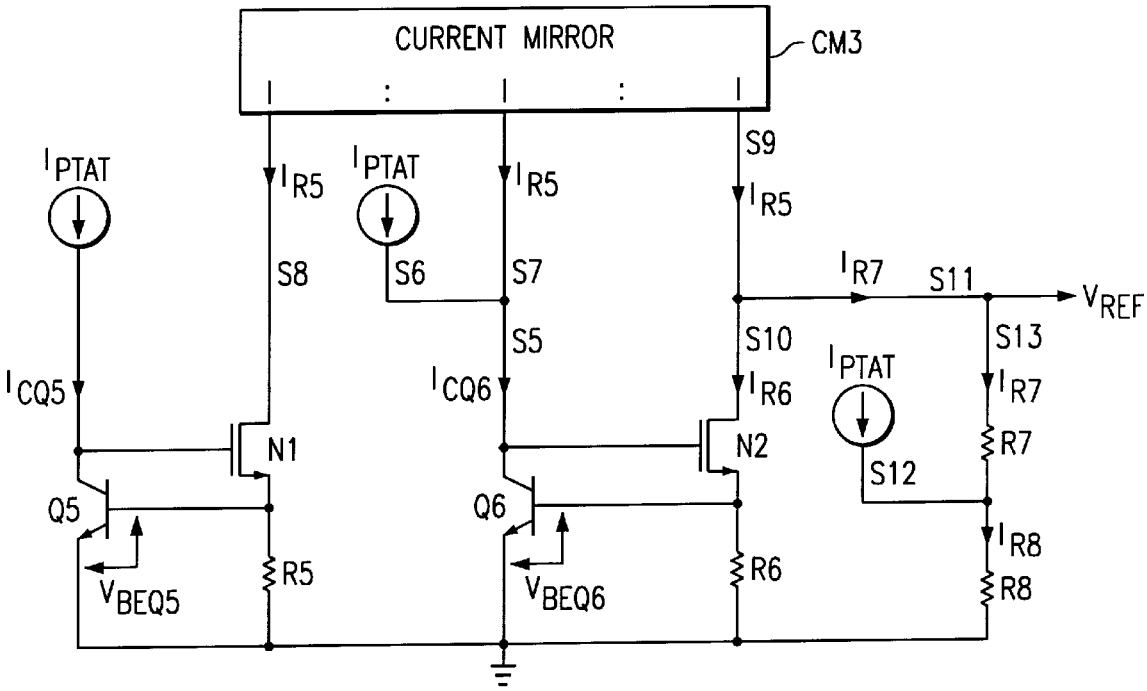
FIG. 6 is a partial schematic diagram of a preferred embodiment of the invention.

FIG. 6 is a partial schematic diagram of a preferred embodiment of the present invention. Included is circuitry for developing a first order temperature-independent current, and an output stage that provides a bandgap reference voltage. Also included is current mirror circuitry to establish equal currents in various parts of the circuit. NMOS transistor N1 functions in conjunction with the current mirror circuitry CM3 to mirror, via signal line S8, the base-emitter dependent current in resistor R5 to the output stage via signal line S9.

The first order temperature-independent current is realized by summing a PTAT current with a second current dependent upon a base-emitter voltage. The collector current of transistor Q6 in signal line S5 is the sum of the currents in signal lines S6 and S7:

$$I_{CQ6}=I_{PTAT}+I_{R5}. \quad \text{Eq. (10)}$$

Figure 1:
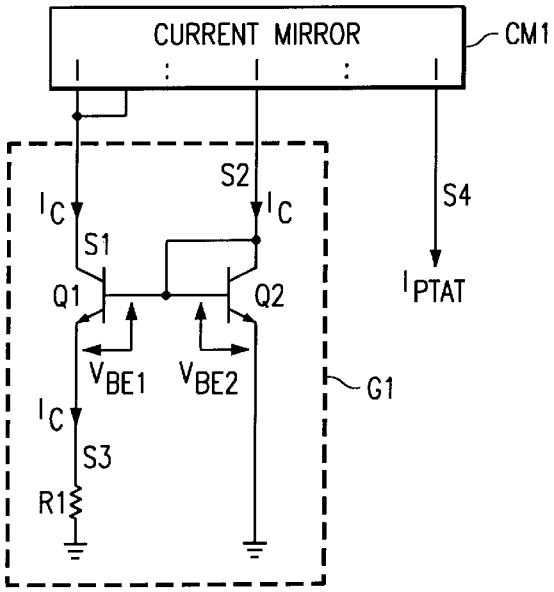
FIG. 1 (PRIOR ART)
FIG. 1 is a schematic diagram of a PTAT current generator.
Figure 2:
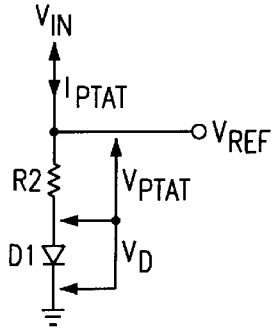
FIG. 2 (PRIOR ART)
FIG. 2 is a schematic diagram of a first order bandgap reference.
Figure 3:
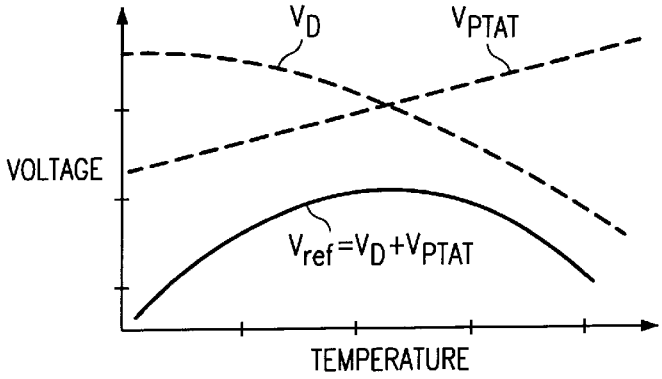
FIG. 3 (PRIOR ART)
FIG. 3 is a plot of the voltage-temperature characteristics of a first order bandgap reference.

Current $I_{PTAT}$ is supplied by a PTAT current generator, such as PTAT current generator CM1 of FIG. 1, and is mirrored to signal lines S6 and S12. Current $I_{R5}$, mirrored to signal line S7 from signal line S8, is given by the equation:

$$I_{R5} = \frac{V_{BEQ5}}{R5}, \quad \text{Eq. (11)}$$

where $V_{BEQ5}$ is the base-emitter voltage of transistor Q5.

Equation (10) may therefore be rewritten as:

$$I_{CQ6} = I_{PTAT} + \frac{V_{BEQ5}}{R5}, \quad \text{Eq. (12)}$$

where $I_{PTAT}$ is determined by Equation (7) and $V_{BEQ5}$ is determined by Equation (1). Current $I_{CQ6}$ is made to be mostly temperature-independent by correctly proportioning $I_{PTAT}$ and $V_{BEQ5}$R5 such that the complementary changes with temperature of these two currents are offsetting. This is done in the design process when establishing the magnitude of the PTAT current, the performance parameters of transistor Q5, and the value of R5. This provides an approximate first order current that is independent of temperature.

Current $I_{R5}$ is also mirrored to signal line S9 in FIG. 6 and branched to signal lines S10, carrying current $I_{R6}$, and S11, carrying current $I_{R7}$, so that:

$$I_{R5}=I_{R6}+I_{R7}. \quad \text{Eq. (13)}$$

Current $I_{R6}$ is determined by the base-emitter voltage of transistor Q6:

$$I_{R6} = \frac{V_{BEQ6}}{R6}, \quad \text{Eq. (14)}$$

noting that the collector current of transistor Q6 is a first order current that is independent of temperature.

Output voltage $V_{REF}$ on signal line S11 is given by the equation:

$$V_{REF}=I_{R7}(R7+R8)+I_{PTAT}R8, \quad \text{Eq. (15)}$$

where current $I_{PTAT}$ is supplied by the PTAT current generator of FIG. 1 mirrored to signal line S12. All of current $I_{R7}$ can be assumed to go into signal line S13 since a reference voltage typically has negligible loading.

Since $I_{R7}=I_{R5}-I_{R6}$ from Equation (13), and substituting Equation (11) and Equation (14) into Equation (15), Equation (15) becomes:

$$V_{REF} = \left(\frac{V_{BEQ5}}{R5} - \frac{V_{BEQ6}}{R6}\right)(R7 + R8) + I_{PTAT}R8, \quad \text{Eq. (16)}$$

where $V_{BEQ5}$ and $V_{BEQ6}$ are defined by Equation (1), and $I_{PTAT}$ is given by Equation (7), as discussed previously.

Referring to Equation (1), x=1 for the linear temperature-dependent collector current of transistor Q5 and x=0 for the first order temperature-independent collector current of transistor Q6. Also, transistors Q5 and Q6 can be designed such that $V_{BE-T_R}$ in Equation (1) is the same value for each transistor at temperature $T_R$. The respective versions of Equation (1) for $V_{BEQ5}$ and $V_{BEQ6}$ therefore become:

$$V_{BEQ5} = V_{g0} - \frac{T}{T_R}(V_{g0} - V_{BE\text{-}T_R}) - (n-1)\left(\frac{kT}{q}\right)\ln\left(\frac{T}{T_R}\right), \quad \text{Eq. (17)}$$

and

-continued $$V_{BEQ6} = V_{g0} - \frac{T}{T_R}(V_{g0} - V_{BE\text{-}T_R}) - (n-0)\left(\frac{kT}{q}\right)\ln\left(\frac{T}{T_R}\right). \quad \text{Eq. (18)}$$

Substituting Equation (17) and Equation (18) into Equation (16), and collecting terms yields:

$$V_{REF} = (R7 + R8)\left(\frac{1}{R5} - \frac{1}{R6}\right)\left(V_{g0} - \frac{T}{T_R}(V_{g0} - V_{BE\text{-}T_R})\right) - (R7 + R8)\left(\frac{n-1}{R5} - \frac{n}{R6}\right)V_T\ln\left(\frac{T}{T_R}\right) + I_{PTAT}R8. \quad \text{Eq. (19)}$$

The temperature dependence of $V_{REF}$ is eliminated by designing $I_{PTAT}$R8 to equal the linear term in Equation (19) multiplied by the resistance ratios:

$$I_{PTAT}R8 = (R7 + R8)\left(\frac{1}{R5} - \frac{1}{R6}\right)\left(\frac{T}{T_R}(V_{g0} - V_{BE\text{-}T_R})\right), \quad \text{Eq. (20)}$$

and by using the following design relationship to cancel the non-linear temperature-dependent logarithmic term:

$$\frac{n-1}{R5} - \frac{n}{R6} = 0, \text{ or } \frac{R6}{R5} = \frac{n}{n-1}. \quad \text{Eq. (21)}$$

As stated previously n is a temperature-independent variable determined in the manufacturing process for a transistor and typically has a value in the range of 3.6–4.0.

Applying the conditions set by Equation (20) and Equation (21), Equation (19) becomes:

$$V_{REF} = V_{g0}(R7 + R8)\left(\frac{1}{R5} - \frac{1}{R6}\right), \quad \text{Eq. (22)}$$

which is a linear relationship independent of temperature. It can be seen from Equation (22) that an exact curvature correction is achieved by the invention, at least at the theoretical level, having eliminated all temperature-dependent and logarithmic parameters. Actual performance of real embodiments shows substantial conformance with theoretical predictions.

Figure 7:
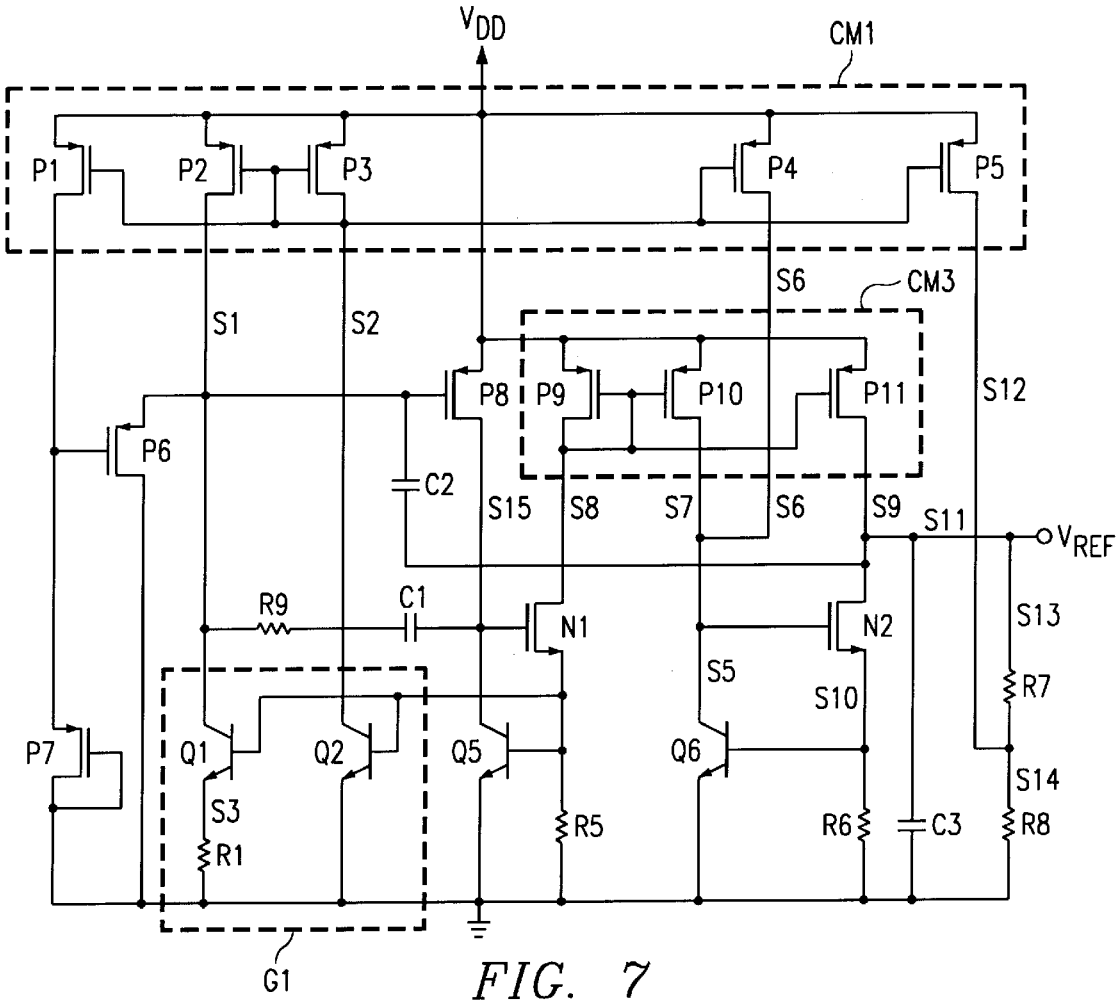
FIG. 7 is a complete schematic diagram of a preferred embodiment of the invention.

FIG. 7 is a complete schematic diagram of the embodiment of FIG. 6. It includes the PTAT current generator of FIG. 1, the circuitry of FIG. 6, and the current mirror circuitry of FIGS. 1 and 6.

The PTAT current generator arrangement of FIG. 1 is comprised of generator circuit G1, comprising transistors Q1, Q2, and resistor R1 in FIG. 7, and current mirror circuit CM1. Current mirror circuit CM1 in FIG. 7 is comprised of PMOS transistors P1 through P5. Current mirror CM1 mirrors the PTAT current generated in generator circuit G1 to signal line S6, and thus to signal line S5 which carries the collector current of transistor Q6. It also supplies the PTAT current to resistor R8 via signal line S12.

The current mirror CM3 of FIG. 6 is comprised in FIG. 7 of PMOS transistors P9 through P11 and NMOS transistor N1. Current mirror CM3 serves to mirror the current in resistor R5 to signal lines S7 and S9.

The collector current of transistor Q6 in signal line S5 is the sum of the mirrored currents in signal lines S6 and S7. The current in resistor R6 supplied through NMOS transistor N2 via signal line S10 is a function of the base-emitter voltage of transistor Q6, and is part of the total current in signal line S9.

The current in signal line S11 of FIG. 7 is the current in signal line S10 subtracted from the current in signal line S9. The current in resistor R7 in signal line S13 is the same as that in signal line Sl. The current in signal line S12 is mirrored from the PTAT current generator G1. The current in resistor R8 in signal line S14 is the sum of the currents in signal lines S12 and S13.

Summarizing, the base-emitter voltage of transistors Q5 and Q6 are translated to currents by resistors R5 and R6, respectively, and provided to the output stage where a current subtraction is realized as shown by Equation (13). The base-emitter dependent currents in resistors R5 and R6 are each temperature-dependent in accordance with Equation (1). The current resulting from the subtraction is summed with a PTAT current in a voltage divider network comprised of resistors R7 and R8 which determines the value of the circuit's output voltage, as shown by equations (15) and (16).

A linear, temperature-independent output voltage is realized by using the PTAT current in resistor R8 to offset part of the temperature dependence of the output voltage as shown by Equation (20). The remainder of the temperature dependence of the output voltage is offset by setting the transistors' process-dependent variable as shown by Equation (21). The desired relationship for the output voltage is shown by equation (22) which is dependent only on the energy-bandgap voltage of the semiconductor material and a resistance ratio.

FIG. 7 also includes PMOS transistors P6 through P8, resistor R9, and capacitors C1 through C3. Transistors P6 through P8 comprise start-up circuitry that ensures the correct operation of the PTAT current generator of FIG. 1. Resistor R9 and capacitors C1 through C3 are required for frequency compensation under transient conditions due to positive and negative feedback loops that exist within the circuit of FIG. 7. While these components are required for functional stability, they are not pertinent to the underlying theories of the invention.

Potential sources of error that can cause an other than exact curvature correction include mismatches in the current mirror circuitry, resistor value tolerances, mismatches in transistor emitter areas, and temperature coefficients of the various resistors. These errors typically result in non-ideal relationships in particular for base-emitter voltages and the PTAT current, but can be minimized or eliminated using an iterative design approach.

Figure 4:
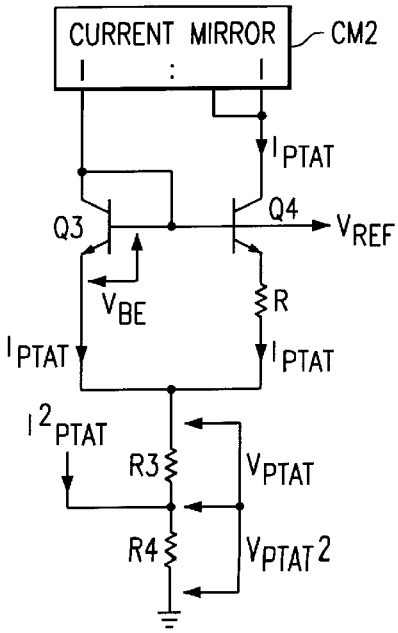
FIG. 4 (PRIOR ART)
FIG. 4 is a schematic diagram of a second order bandgap reference.
Figure 5:
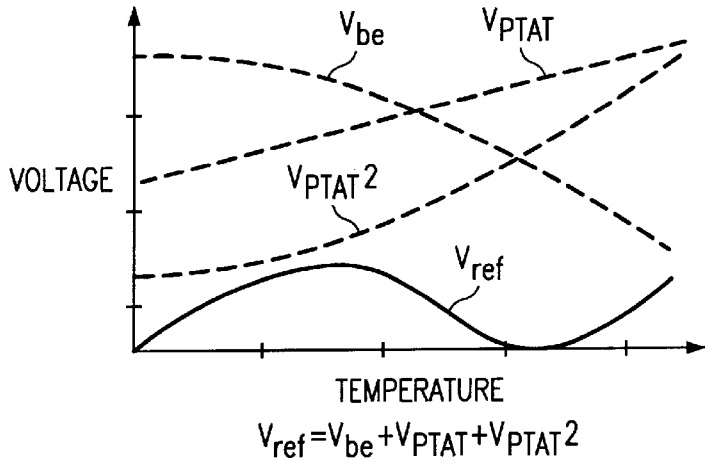
FIG. 5 (PRIOR ART)
FIG. 5 is a plot of the voltage-temperature characteristics of a second order bandgap reference.
Figure 8:
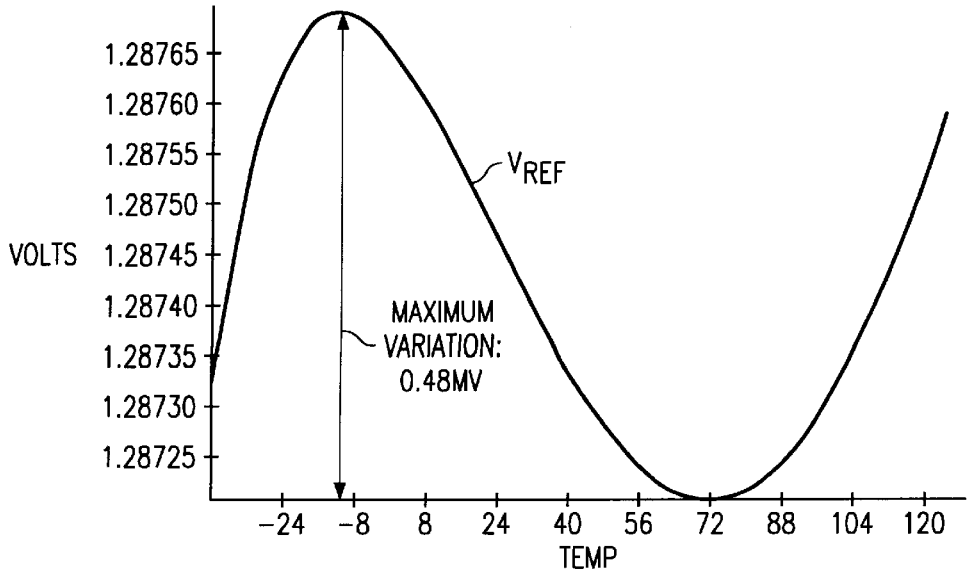
FIG. 8 is a plot of the output voltage of a preferred embodiment of the invention versus temperature.

FIG. 8 is a plot of the output voltage, $V_{REF}$, of FIG. 7 versus temperature. It can be seen in FIG. 8 that the maximum variation of $V_{REF}$ over the temperature range of −40 to +125 degC. is 0.48 millivolts. By comparison, the second order bandgap reference of FIG. 4 would exhibit a variation of 5 millivolts or more over the same temperature range.

The plot of FIG. 8 was obtained with resistance values of 22.35, 244.0, 319.08, 937.1, and 99.9, all kilohms, for resistors R1, R5, R6, R7, and R8, respectively.

Although the present invention and its advantages have been described in detail, it should be understood that various changes, substitutions and alterations can be made herein without departing from the spirit and scope of the invention as defined by the appended claims. For example, numerous variations from the specific embodiments disclosed herein may be made, while still applying the principles of the present invention. Minor changes, for example, include the replacement of the PMOS transistors included in the embodiment as shown in FIG. 7 with PNP transistors with appropriate characteristics and the replacement of the NMOS transistors in the same figure with NPN transistors with appropriate characteristics. Similarly, for a negative reference (with respect to ground), all P-type devices can be changed to N-type devices and vice-versa, given that the positive supply is ground and the negative supply is a voltage below ground. The choice for these and any variations would be dictated by the specific design requirements for a particular application of the invention. All such variations are considered within the scope of the invention, which is determined solely by reference to the appended claims.

I claim:

1. A curvature corrected bandgap reference voltage circuit, the output voltage of which is substantially linear and independent of the operating temperature of the circuit, comprising:

a voltage divider network comprised of a first resistor and a second resistor connected in series;

a first compensating circuit providing a first, linear, operating temperature-dependent current;

a second compensating circuit providing a second, logarithmic, operating temperature-dependent current;

means for supplying said first current to said first resistor of said voltage divider network; and means for supplying said second current to said second resistor of said voltage divider network.

2. The circuit of claim 1, further comprising a third current source and a fourth current source, said third current source and said fourth current source being determined by a base-emitter voltage of respective bipolar transistors, wherein said second current corresponds to said fourth current, minus said third current.

3. The circuit of claim 2, further comprising:

a first current mirror circuit mirroring a fifth current flowing into a collector electrode of a first NPN transistor, said fifth current being proportional to an absolute temperature of said first NPN transistor, and providing said first current;

a second current mirror circuit mirroring a sixth current flowing through a third resistor, said sixth current being proportional to a voltage between a base electrode and an emitter electrode of a second NPN transistor, and providing said third current; and a third current mirror circuit mirroring a seventh current flowing through a fourth resistor, said seventh current being proportional to a voltage between a base electrode and an emitter electrode of a third NPN transistor, and providing said fourth current.

4. The circuit of claim 3, further comprising:

a fourth current mirror circuit mirroring an eighth current flowing into a collector electrode of a fourth NPN transistor and flowing from a emitter electrode of said fourth NPN transistor into a fifth resistor, and providing said fifth current;

whereby:

the voltage between said base and said emitter electrodes of said second NPN transistor is determined by a current flowing into a collector electrode of said second NPN transistor which is the sum of a ninth current supplied by said first current mirror circuit and a tenth current supplied by said second current mirror circuit; and the voltage between said base and said emitter electrodes of said third NPN transistor is determined by a current flowing into a collector electrode of said third NPN transistor which is an eleventh current supplied by the third current mirror circuit.

5. A temperature compensated bandgap reference voltage circuit, comprising:

a proportional-to-absolute-temperature (PTAT) current generator generating a PTAT current;

a first compensation circuit coupled to said PTAT current generator, generating a first compensated current that is, to a first, linear order, substantially temperature dependent in an opposite direction to a temperature dependence of said PTAT current;

a first current mirror coupled to said first compensation circuit mirroring said first compensated current to a first current line and to a second current line;

a second compensation circuit coupled to said PTAT current generator and to said first current line, generating a second compensated current that is, to a second, non-linear order, substantially temperature dependent in an opposite direction to a temperature dependence of said PTAT current;

a combining node combining said PTAT current and said second compensated current;

a voltage divider network comprising a first resistor and a second resistor coupled in series, an end of said network being coupled to a common ground node, another end of said network being coupled to said combining node, the common connection point of said third resistor and of said fourth resistor being coupled to said PTAT current generator, said second combining node comprising an output of said temperature compensated bandgap reference voltage circuit.

6. A temperature compensated bandgap reference voltage circuit, comprising:

a proportional-to-absolute-temperature (PTAT) current generator;

a first bipolar transistor having a base, an emitter and a collector, having its collector coupled to said PTAT current generator;

a first resistor coupled between the base and the emitter of said first bipolar transistor, the emitter of said first bipolar transistor being coupled to a common ground node;

a first current mirror mirroring a current flowing through said first resistor to a first combining node and to a second combining node, said first combining node also being coupled to said PTAT current generator;

a second bipolar transistor having a base, an emitter and a collector, having its collector coupled to said first combining node and having its base coupled to said second combining node;

a second resistor coupled between the base and emitter of said second bipolar transistor, the emitter of said second bipolar transistor being coupled to said common ground node;

a voltage divider network comprising a third resistor and a fourth resistor coupled in series, an end of said network being coupled to said common ground node, another end of said network being coupled to said second combining node and the common connection point of said third resistor and of said fourth resistor being coupled to said PTAT current generator;

said second combining node comprising an output of said temperature compensated bandgap reference voltage circuit.

* * * * *